US010117535B2

(12) United States Patent
Wood

(10) Patent No.: US 10,117,535 B2
(45) Date of Patent: Nov. 6, 2018

(54) WIG HANGERS

(71) Applicant: J Deboy & Co Limited, Woodford Green, Essex (GB)

(72) Inventor: Joy Beverley Wood, London (GB)

(73) Assignee: J Deboy & Co Limited, Woodford Green (GB)

( * ) Notice: Subject to any disclaimer, the term of this patent is extended or adjusted under 35 U.S.C. 154(b) by 0 days.

(21) Appl. No.: 15/394,903

(22) Filed: Dec. 30, 2016

(65) Prior Publication Data

US 2017/0188732 A1 Jul. 6, 2017

(30) Foreign Application Priority Data

Dec. 30, 2015 (GB) ..... 1523079.0

(51) Int. Cl.
*A47G 25/06* (2006.01)
*A47F 7/06* (2006.01)

(52) U.S. Cl.
CPC ..... *A47G 25/0607* (2013.01); *A47F 7/06* (2013.01); *A47F 7/065* (2013.01); *A47G 25/06* (2013.01)

(58) Field of Classification Search
CPC ..... A47G 25/06; A47G 25/0607; A47G 25/0635; A47G 25/10; A47G 25/28; A47G 25/36; A47F 7/06; A47F 7/0605; A45D 44/14; A41H 5/00; A41G 3/00; A41G 3/0041; A41G 5/00
See application file for complete search history.

(56) References Cited

U.S. PATENT DOCUMENTS 1,839,294 A * 1/1932 Boye ..... A47G 25/06 211/32
1,939,027 A * 12/1933 Stewart ..... A47G 25/06 211/32
2,250,831 A * 7/1941 Harrison ..... A47G 25/0607 248/304
3,501,072 A * 3/1970 Kovener ..... A47F 5/04 206/8

(Continued)

FOREIGN PATENT DOCUMENTS

CN 204930690 B 1/2016
DE 2626307 A1 12/1977

(Continued)

OTHER PUBLICATIONS

Search Report under Section 17 in corresponding British application No. GB1622389.3, dated May 23, 2017, 1 pp.

(Continued)

*Primary Examiner* — Ismael Izaguirre
(74) *Attorney, Agent, or Firm* — Tredecim LLC; Sean L. Sweeney; Taylor A. Noonan

(57) ABSTRACT

A wig hanger is disclosed comprising a domed structure which can be skeletal and formed of two interlocked D-shaped members (11, 12). The domed structure has a flat base. Extending from the side of the base is a vertical support bar (13) which extends upwardly and then curves round to a position located substantially above the centre of the dome and which has a hook-shaped end (15). An additional hook (20) may fit on to the vertical support bar (13) to enable the hanger with a wig on it to be hung on a wall.

5 Claims, 3 Drawing Sheets

(56) References Cited

U.S. PATENT DOCUMENTS

| | | | | |
|---|---|---|---|---|
| 4,944,480 | A * | 7/1990 | Jarrett | A47G 25/0607 248/304 |
| 5,624,041 | A * | 4/1997 | Van Druff, Jr. | A47F 7/06 211/30 |
| 6,349,862 | B1 * | 2/2002 | Smith | A47G 25/10 223/24 |
| 8,439,210 | B1 * | 5/2013 | Griffith | A47G 25/10 211/106.01 |
| D702,964 | S | 4/2014 | Sterling | |

FOREIGN PATENT DOCUMENTS

| | | | |
|---|---|---|---|
| GB | 1151455 | B1 | 5/1969 |
| KR | 1764243 | B1 * | 8/2017 |

OTHER PUBLICATIONS

English Abstract of item CN204930690, Jan. 6, 2016, to Zhnag, 1 pp. (via Espacenet).

Future Eyes, B00MB8H40S, Amazon.com, available at https://www.amazon.com/Clean-Stand-Hanger-Cosplay-Import/dp/B00MB8H40S, last visited Dec. 30, 2016.

* cited by examiner

WIG HANGERS

BACKGROUND

1. Field of the Invention

This invention relates to wig hangers.

2. Discussion of Background Information

It is desirable to store wigs when not required for use in a way which preserves their shape and which, however, does not take up more space than necessary. A variety of stands is available in the marketplace, but while a stand may be satisfactory to maintain the wig shape, for example by incorporating a mannequin head on a base or providing some form of head-shaped framework, the stand has to have something to stand on when the wigs are stored which is consumptive of space and, additionally, stands tend to be of a height corresponding to the longest wig it is likely to be designed to store, and any shorter wig accordingly takes up more space when stored than is strictly necessary.

The patent literature includes a number of disclosures of wig stands and also of wig hangers. In particular, GB1151455(A) and DE2626307A1 disclose wig hanger constructions consisting of a hook connected via a laterally extending member to a relatively thin arched support structure. Hangers of the type disclosed in these two specifications support the wig from the inside only over a relatively narrow area running from front to back of the wig. This means that the wig tends to go out of shape when stored for any material length of time.

An alternative known construction of wig hanger consists of two interlocking oval plastics rings, one of which can be clipped inside the other so that the plane of each ring is perpendicular to the plane of the other, and attached to the narrower end of one of the oval rings is an extension which, when the wider end of the oval ring is upwards, goes down sideways and then loops upwards to a position over the top of the oval ring and terminates in a hook-shaped end which can be slipped over a suspension rail. A circular ring may be fitted to the two oval rings when assembled, the plane of the circular ring being perpendicular to the planes of the two oval rings, so that the wider end of the ovoid shape formed by the three rings has a horizontal support running round it. The complete assembly accordingly provides a framework of generally egg shape, wider end upwards, on to which a wig may be placed. A disadvantage of his construction is that the hanger acts merely as a hanger, i.e. it does not act as a stand in any way.

SUMMARY OF THE INVENTION

According to the present invention, there is provided a wig hanger comprising a domed structure having a flat base and extending from the side of the base, a vertical support bar which extends upwardly and then curves round to a position located substantially above the centre of the dome and which has a hook-shaped end. The dome shape construction acts as a support for the wig itself while the vertically extending member acts as a hook which can be hooked over a rail to suspend the wig for storage. It is preferred that in addition to having a hooked end, the vertical support base has a secondary hook or loop formed on or fixable to it so that it may be hooked over an appropriately shaped and sized wall-mounted hook, stud or the like, thus avoiding the need for a rail.

The flat-bottomed dome-shaped portion of the wig hanger in accordance with the invention may have a continuous dome-shaped surface, but preferably is skeletal, e.g. formed of two generally D-shaped sections, the sections having means to fit them together so that the planes of each section are at right angles to one another. The fitting together may take a variety of forms but it is particularly preferred that the members are made of resilient plastics material allowing one to be clipped into the other to construct the dome-shaped base structure, and to be simply unclipped to enable the wig hanger to be stored flat.

BRIEF DESCRIPTION OF THE DRAWINGS

These and other features, aspects and advantages of the present invention will become better understood with reference to the following description, appended claims, and accompanying drawings where:

DETAILED DESCRIPTION OF THE INVENTION

Figure 1:
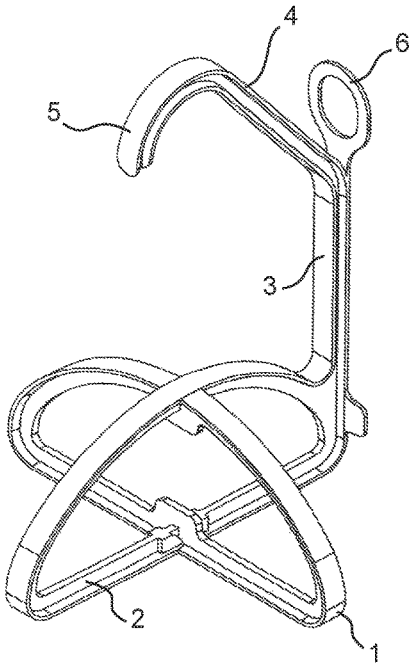
FIG. 1 is a perspective view of a first embodiment of a wig hanger in accordance with the present invention.
Figure 2:
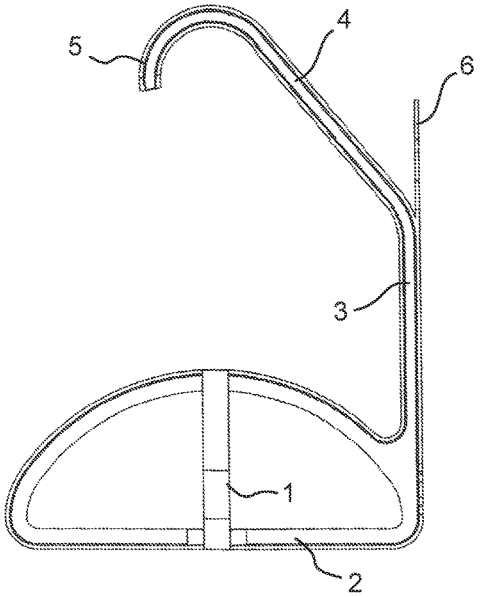
FIG. 2 is a side view of the wig hanger shown in FIG. 1.
Figure 3:
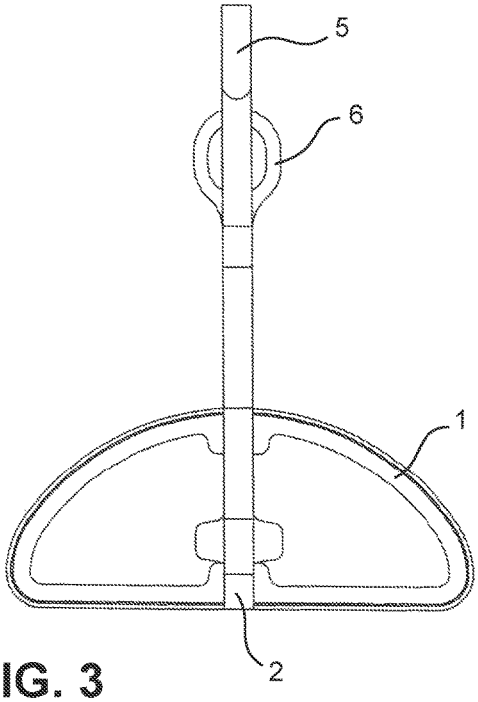
FIG. 3 is a front view of the wig hanger shown in FIG. 1.
Figure 4:
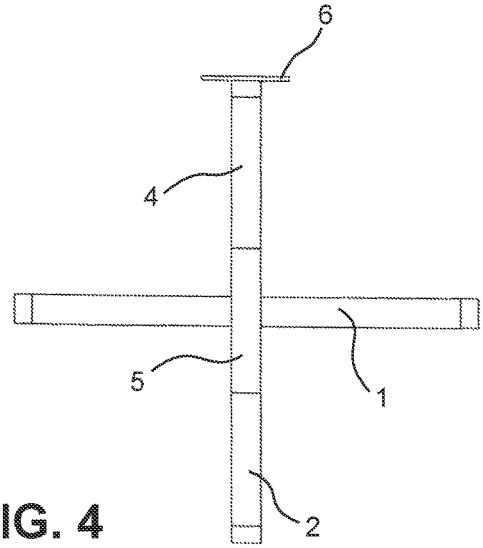
FIG. 4 is a top view of the of the wig hanger shown in FIG. 1.

Referring to FIGS. 1 to 4 of the drawings, the wig hanger there illustrated consists of two plastics mouldings 1, 2 which are clipped together as explained below. Member 1 is essentially a simple D-shape while member 2 is a D-shape with a bar 3 extending at right angles to the vertical stroke of the D, having a top section 4 which extends at an angle and terminates at a hook-shaped end 5. Integrally moulded with the bar 3 at the position where section 4 diverges from the vertical is a ring 6.

The two components are made of resilient plastics material and component 1 has two recessed sections on the exterior of its perimeter and halfway up the "D" shape. These can be sprung into the inside of the D-shaped part of component 2.

The hanger with a wig on can be hung up on a rail by the hook-shaped end 5 or hung on a wall by putting the ring 6 over a hook or stud mounted on a wall, or, for example, on the inside of a wardrobe door.

Figure 5:
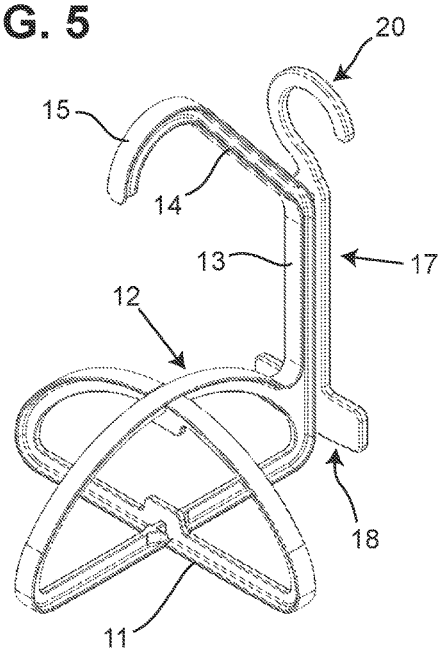
FIG. 5 is a perspective view of a second embodiment of a wig hanger in accordance with the present invention.
Figure 6:
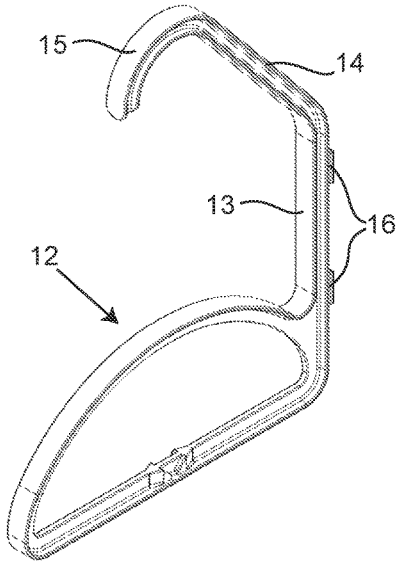
FIG. 6 is a perspective view of a first component of the wig hanger shown in FIG. 5.
Figure 7:
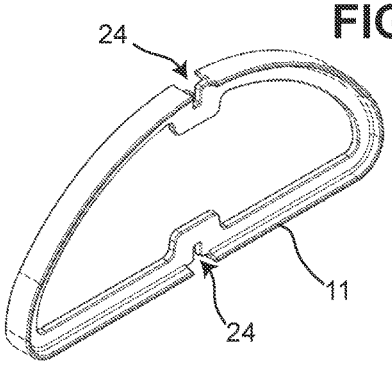
FIG. 7 is a perspective view of a second component of the wig hanger shown in FIG. 5.
Figure 8:
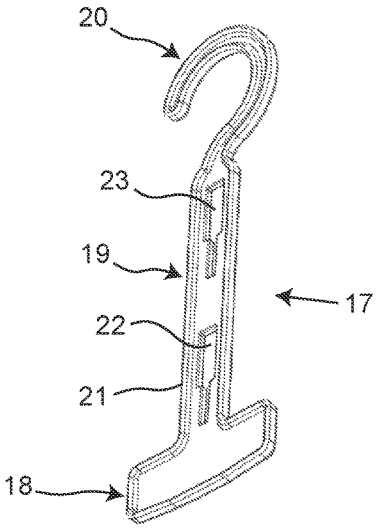
FIG. 8 is a perspective view of a third component of the wig hanger shown in FIG. 5.

Referring to FIGS. 5 to 8 of the drawings, the wig hanger there illustrated consists of two plastics mouldings 11, 12 which are clipped together as in the case of the embodiment shown in FIGS. 1 to 4. Member 12 is a D-shape with a bar 13 extending at right angles to the vertical stroke of the D, having a top section 14 which extends at an angle and terminates at a hook-shaped end 15. Bar 13 carries two integrally moulded tabs 16, each of which is of oblong shape and spaced from the main portion of bar 13 by a short vertical rib. FIG. 8 shows a hook portion 17 which may be fitted on to the bar 13. Hook portion 17 has a lower winged part 18, a central flat part 19 and an upper hook part 20, all of which are bounded by a skirt 21, as can be seen clearly in FIG. 8. The flat part 19 has two apertures 22, 23 in it, each of which is in the shape of an oblong corresponding to the shape and size of tabs 16, from each of which extends a slot of width corresponding to that of the rib between bar 13 and tab 16. The depth of skirt 21 is slightly greater that the overall distance by which the tabs 16 project from the rear of member 12. Hook portion 17 can be simply fitted on to the bar 13, as shown in FIG. 5, if it is desired to suspend the hanger from a hook or stud projecting from a wall or door. Hook part 20 engages over the projecting hook or stud, and the winged part 18 lies against the wall to prevent the hanger swaying laterally when an assembly of wig and wig hanger is hung up in this way.

As in the case of the embodiment shown in FIGS. 1 to 4, the components are made of resilient plastics material. Member 11 has two recessed sections 24 on the exterior of its perimeter and halfway up the "D" shape which can be sprung into the inside of the D-shaped part of component 12.

What is claimed is:

1. A wig hanger comprising a domed structure having a flat base and extending from the side of the base, a vertical support bar which extends upwardly and then curves round to a position located substantially above the centre of the dome and which has a hook-shaped end, wherein the vertical support bar carries a second hook-shaped portion enabling hanger to be hung on a projecting stud or hook on a wall or door.

2. The wig hanger according to claim 1 wherein the flat-bottomed dome-shaped portion of the wig hanger is formed of two generally D-shaped sections, the sections having means to fit them together so that the planes of each section are at right angles to one another.

3. The wig hanger according to claim 2 wherein the two D-shaped sections are made of resilient plastics material allowing one to be clipped into the other to construct the dome-shaped base structure.

4. The wig hanger according to claim 3 wherein the sections are made of resilient plastics material allowing them to be clipped together to construct the dome-shaped base structure, and to be simply unclipped to enable the wig hanger to be stored flat.

5. A wig hanger comprising a domed structure having a flat base and extending from the side of the base, a vertical support bar which extends upwardly and then curves round to a position located substantially above the centre of the dome and which has a hook-shaped end, wherein the vertical support bar carries a second hook-shaped portion enabling hanger to be hung on a projecting stud or hook on a wall or door, wherein the second hook-shaped portion is part of a component which can be attached to or detached from the vertical section of the support bar.

* * * * *